US011306626B2

(12) United States Patent
Camilo

(10) Patent No.: US 11,306,626 B2
(45) Date of Patent: Apr. 19, 2022

(54) CAMSHAFT PHASER WITH TARGET WHEEL WASHER

(71) Applicant: Schaeffler Technologies AG & Co. KG, Herzogenaurach (DE)

(72) Inventor: Alexandre Camilo, Rochester Hills, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 10 days.

(21) Appl. No.: 16/890,252

(22) Filed: Jun. 2, 2020

(65) Prior Publication Data

US 2021/0372300 A1 Dec. 2, 2021

(51) Int. Cl.

| | |
|---|---|
| ***F01L 1/34*** | (2006.01) |
| ***F01L 1/344*** | (2006.01) |
| ***F01L 1/047*** | (2006.01) |

(52) U.S. Cl.

CPC ..... *F01L 1/3442* (2013.01); *F01L 1/047* (2013.01); *F01L 1/34409* (2013.01); *F01L 2001/34426* (2013.01); *F01L 2001/34483* (2013.01); *F01L 2820/041* (2013.01)

(58) Field of Classification Search

CPC ..... F01L 1/3442; F01L 1/047; F01L 1/34409; F01L 2820/041; F01L 2001/34426; F01L 2001/34483

See application file for complete search history.

(56) References Cited

U.S. PATENT DOCUMENTS

| | | | | |
|---|---|---|---|---|
| 6,609,498 | B2 | 8/2003 | Mathews et al. | |
| 7,305,949 | B2 | 12/2007 | McCarthy et al. | |
| 2007/0039576 | A1* | 2/2007 | McCarthy | F01L 1/3442 123/90.15 |
| 2010/0089349 | A1* | 4/2010 | Yudate | F01L 1/3442 123/90.17 |
| 2015/0267570 | A1* | 9/2015 | Bayrakdar | F01L 1/3442 123/90.17 |
| 2020/0056515 | A1 | 2/2020 | Camilo et al. | |

* cited by examiner

*Primary Examiner* — Zelalem Eshete
(74) *Attorney, Agent, or Firm* — Volpe Koenig

(57) ABSTRACT

A camshaft phaser, including: a stator arranged to receive rotational torque, including a plurality of radially inwardly extending protrusions, and supported for rotation around an axis of rotation; a rotor including a plurality of radially outwardly extending protrusions circumferentially interleaved with the plurality of radially inwardly extending protrusions, and arranged to non-rotatably connect to a camshaft; a plurality of phaser chambers, each phaser chamber circumferentially bounded by a radially inwardly extending protrusion included in the plurality of radially inwardly extending protrusions and a radially outwardly extending protrusion included in the plurality of radially outwardly extending protrusions; an annular washer; and a target wheel including a first portion axially located between the annular washer and the rotor and in contact with the annular washer, arranged to detect a rotational position of the rotor for use in rotating the rotor with respect to the stator.

13 Claims, 9 Drawing Sheets

CAMSHAFT PHASER WITH TARGET WHEEL WASHER

TECHNICAL FIELD

The present disclosure relates to a camshaft phaser with a target wheel washer to eliminate rotation of a target wheel for the camshaft phaser during assembly of the camshaft phaser or connection of the camshaft phaser to a camshaft.

BACKGROUND

It is known to fix an oil control valve to a camshaft phaser or to connect a camshaft phaser to a camshaft with a bolt. The oil control valve and the bolt are rotated to connect to the camshaft phaser and the camshaft, respectively. During the rotation, the oil control valve and the bolt frictionally contact a target wheel for the respective camshaft. The frictional contact with the target wheel, which is typically fabricated from a low-carbon steel, can cause galling of the target wheel and rotation of the target wheel from a calibrated position of the target wheel, degrading the performance of the target wheel and the respective camshaft phaser. It is known to apply grease between the target wheel to prevent galling of the target wheel and rotation of the target wheel. However, applying the grease adds complexity and cost to fabrication of the respective camshaft phasers.

SUMMARY

According to aspects illustrated herein, there is provided a camshaft phaser, including: a stator arranged to receive rotational torque, including a plurality of radially inwardly extending protrusions, and supported for rotation around an axis of rotation; a rotor including a plurality of radially outwardly extending protrusions circumferentially interleaved with the plurality of radially inwardly extending protrusions, and arranged to non-rotatably connect to a camshaft; a plurality of phaser chambers, each phaser chamber circumferentially bounded by a radially inwardly extending protrusion included in the plurality of radially inwardly extending protrusions and a radially outwardly extending protrusion included in the plurality of radially outwardly extending protrusions; an annular washer; and a target wheel including a first portion axially located between the annular washer and the rotor and in contact with the annular washer, arranged to detect a rotational position of the rotor for use in rotating the rotor with respect to the stator.

According to aspects illustrated herein, there is provided a camshaft phaser, including: a stator arranged to receive rotational torque, including a plurality of radially inwardly extending protrusions, and supported for rotation around an axis of rotation; a rotor arranged to non-rotatably connect to a camshaft, and including a plurality of radially outwardly extending protrusions circumferentially interleaved with the plurality of radially inwardly extending protrusions; a plurality of phaser chambers, each phaser chamber circumferentially bounded by a radially inwardly extending protrusion included in the plurality of radially inwardly extending protrusions and a radially outwardly extending protrusion included in the plurality of radially outwardly extending protrusions; an annular washer having a first hardness; and a target wheel including a first portion axially disposed between the annular washer and the target wheel, the first portion in contact with the annular washer, having a second hardness, the second hardness less than the first hardness, and arranged to detect a rotational position of the rotor for use in rotating the rotor with respect to the stator.

According to aspects illustrated herein, there is provided a camshaft phaser, including: a stator arranged to receive rotational torque. including a plurality of radially inwardly extending protrusions, and supported for rotation around an axis of rotation; a rotor arranged to non-rotatably connect to a camshaft, and including a plurality of radially outwardly extending protrusions circumferentially interleaved with the plurality of radially inwardly extending protrusions; a plurality of phaser chambers, each phaser chamber circumferentially bounded by a radially inwardly extending protrusion included in the plurality of radially inwardly extending protrusions and a radially outwardly extending protrusion included in the plurality of radially outwardly extending protrusions; an annular washer having a first hardness and including a first surface facing in a first axial direction parallel to the axis of rotation, and a second surface facing in a second axial direction, opposite the first axial direction; and a target wheel including a first portion axially disposed between the annular washer and the target wheel and in contact with the first surface of the annular washer, having a second hardness, the second hardness less than the first hardness, and arranged to detect a rotational position of the rotor for use in rotating the rotor with respect to the stator. The camshaft phaser includes an oil control valve non-rotatably connected to the rotor and including a flange, the oil control valve is arranged to distribute a fluid to the plurality of phaser chambers, the flange is in contact with the second surface of the annular washer, and the flange clamps the annular washer to the target wheel; or the second surface of the annular washer is arranged to contact a bolt arranged to non-rotatably connect the rotor to the camshaft, and the bolt is arranged to clamp the annular washer to the target wheel.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
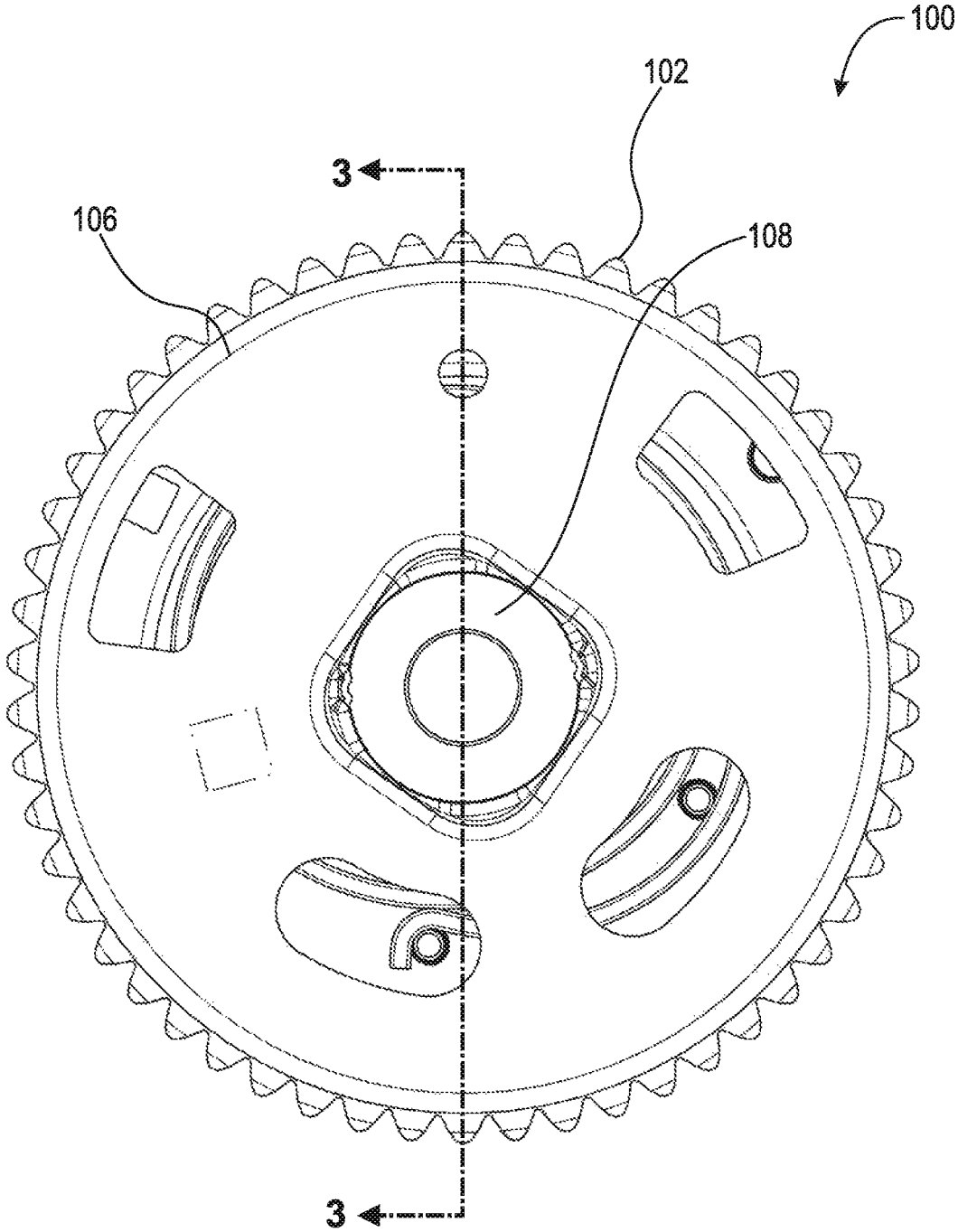
FIG. 1 is a front view of a camshaft phaser with a target wheel washer.

FIG. 1 is a front view of a camshaft phaser with a target wheel washer.

Figure 2:
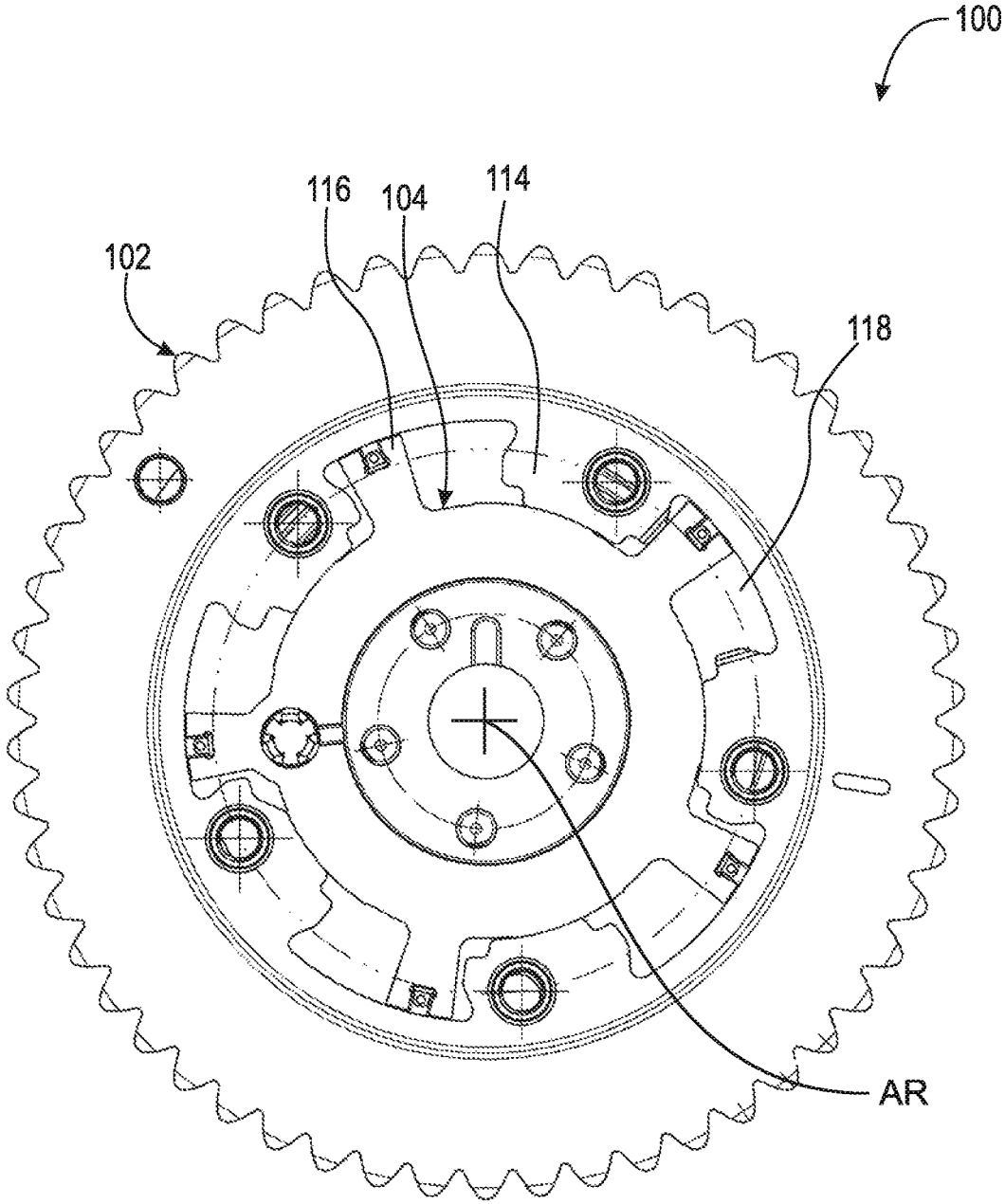
FIG. 2 is a back view of the camshaft phaser shown in FIG. 1 with a back plate removed.

FIG. 2 is a back view of the camshaft phaser shown in FIG. 1 with a back plate removed.

Figure 3:
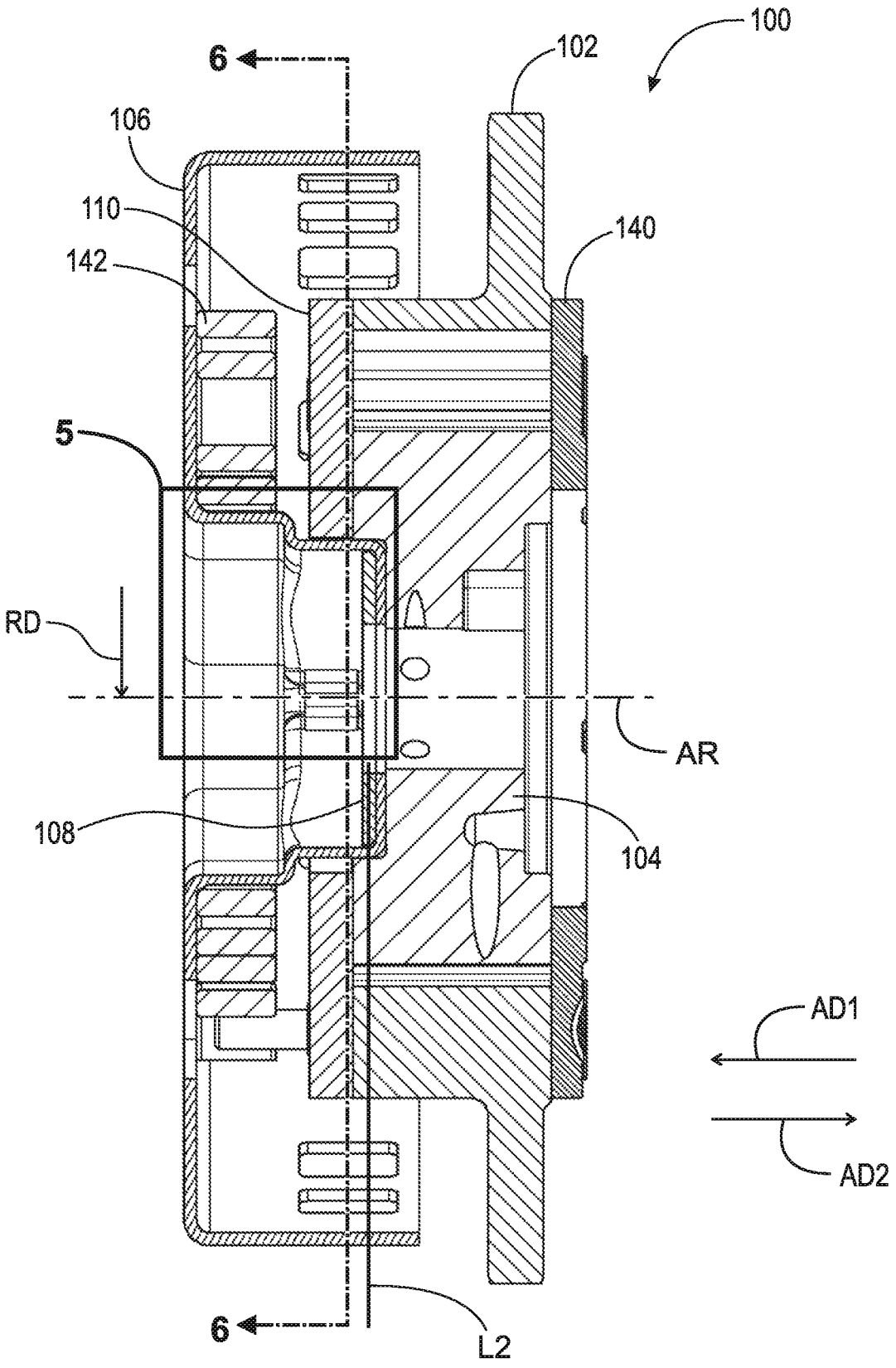
FIG. 3 is a cross-sectional view generally along line 3-3 in FIG. 1.

FIG. 3 is a cross-sectional view generally along line 3-3 in FIG. 1.

Figure 4:
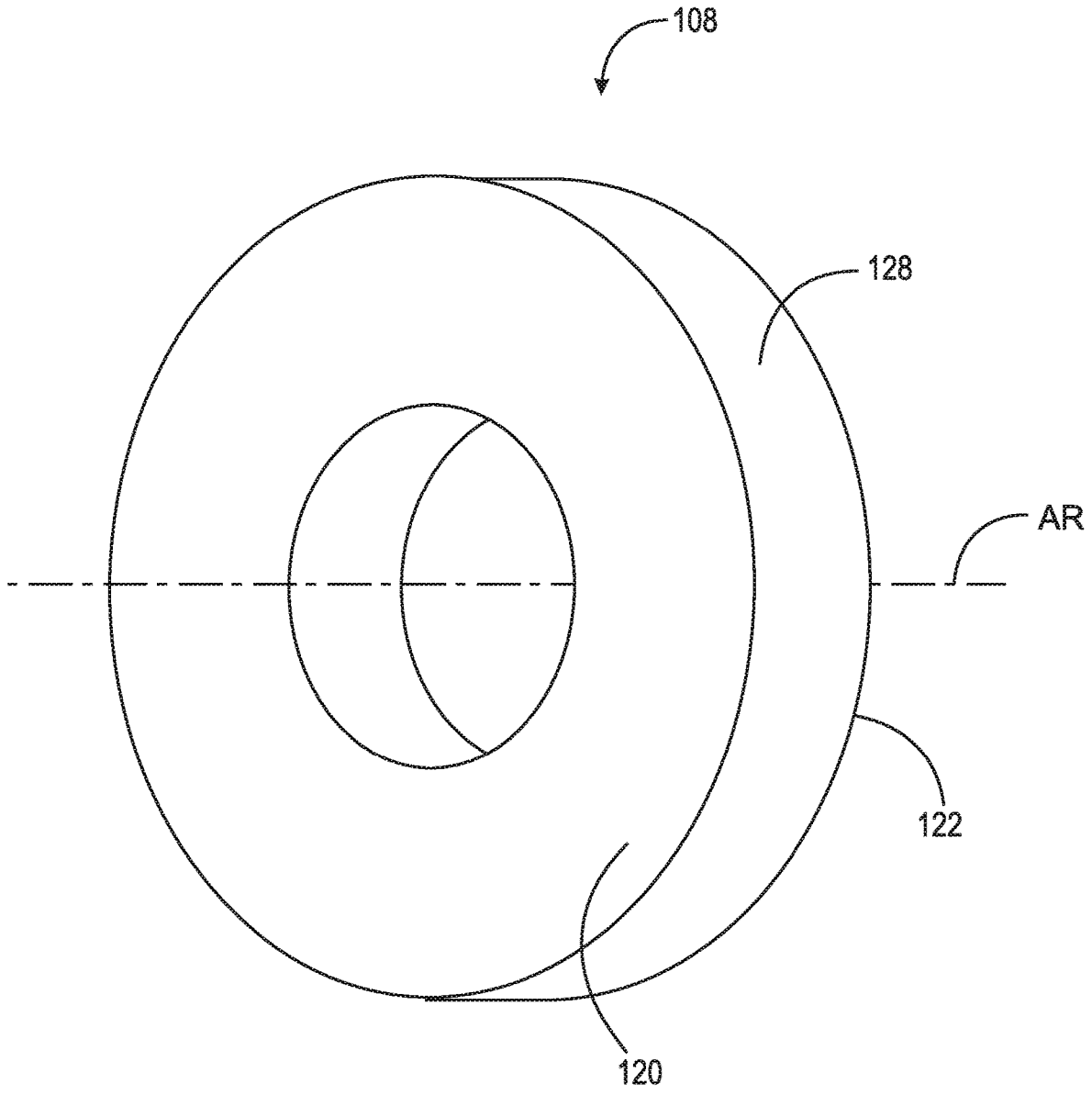
FIG. 4 is an isometric view of a washer of the camshaft phaser shown in FIG. 1.

FIG. 4 is an isometric view of a washer of the camshaft phaser shown in FIG. 1. The following should be viewed in light of FIGS. 1 through 4. Camshaft phaser 100 includes: stator 102 arranged to receive rotational torque; rotor 104 arranged to non-rotatably connect to a camshaft; target wheel 106; and annular, or alternately stated ring-shaped, washer 108, cover plate 110. Target wheel 106 is non-rotatably connected to rotor 104. In the example of FIG. 1, target wheel 106 is non-rotatably connected to rotor 104 by cover plate 110.

Target wheel 106 is arranged to detect a rotational position of rotor 104 for use in rotating rotor 104 with respect to stator 102 to control a rotational position of the camshaft. Target wheel 106 includes portion 112 axially disposed between washer 108 and rotor 104. Washer 108 is in contact with portion 112 of target wheel 106. Portion 112 is directly engaged with rotor 104. By one component "directly engaged with" another component, we mean that the components are in direct contact, or that the components are each in direct contact with one or more ancillary intermediate parts. In the example of FIG. 1, portion 112 is in direct contact with rotor 104.

Stator 102 includes radially inwardly extending protrusions 114 and is supported for rotation around axis of rotation AR. Rotor 104 includes radially outwardly extending protrusions 116 circumferentially interleaved with radially inwardly extending protrusions 114 to form phaser chambers 118. Each phaser chamber 118 is circumferentially bounded by a radially inwardly extending protrusion 114 and a radially outwardly extending protrusion 116.

The hardness of washer 108 is greater than the hardness of target wheel 106. In the example of FIG. 1, the hardness of rotor 104 is greater than the hardness of target wheel 106. The hardness of rotor 104, target wheel 106, and washer 108 is measured by any means or standards known in the art, including but not limited to American Society of Mechanical Engineers (ASME) B18.221 and ASTM International (formerly American Society for Testing and Materials) F436. In an example embodiment, washer 108 is hardened by any means known in the art.

In an example embodiment, rotor 104, target wheel 106, and annular washer 108 are each made of steel and the steel of rotor 104 and washer 108 has a higher carbon content than the steel of target wheel 106. For example, target wheel 106 is made of mild steel having a carbon content less than 0.29 percent. For example, target wheel 106 is made of mild steel having a carbon content less than 0.50 percent.

Figure 5:
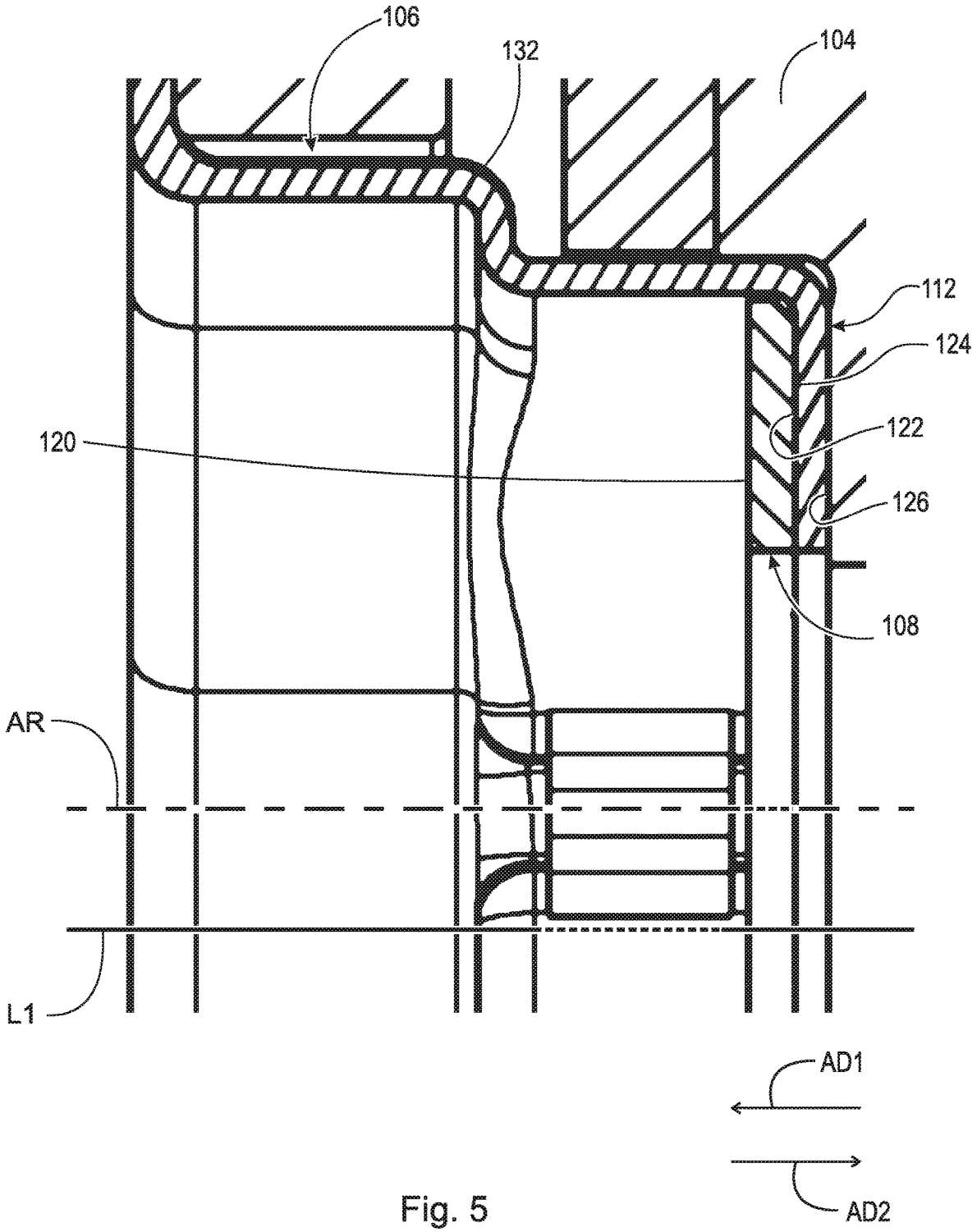
FIG. 5 is a detail of area 5 in FIG. 3.

FIG. 5 is a detail of area 5 in FIG. 3. Washer 108 includes: side 120 facing in axial direction AD1, parallel to axis AR; and side 122 facing in axial direction AD2, opposite direction AD1. Portion 112 includes side 124 facing in direction AD1 and side 126 facing in direction AD2. Side 122 is in contact with side 124, and in the example of FIG. 1, side 126 is in contact with rotor 104.

Figure 6:
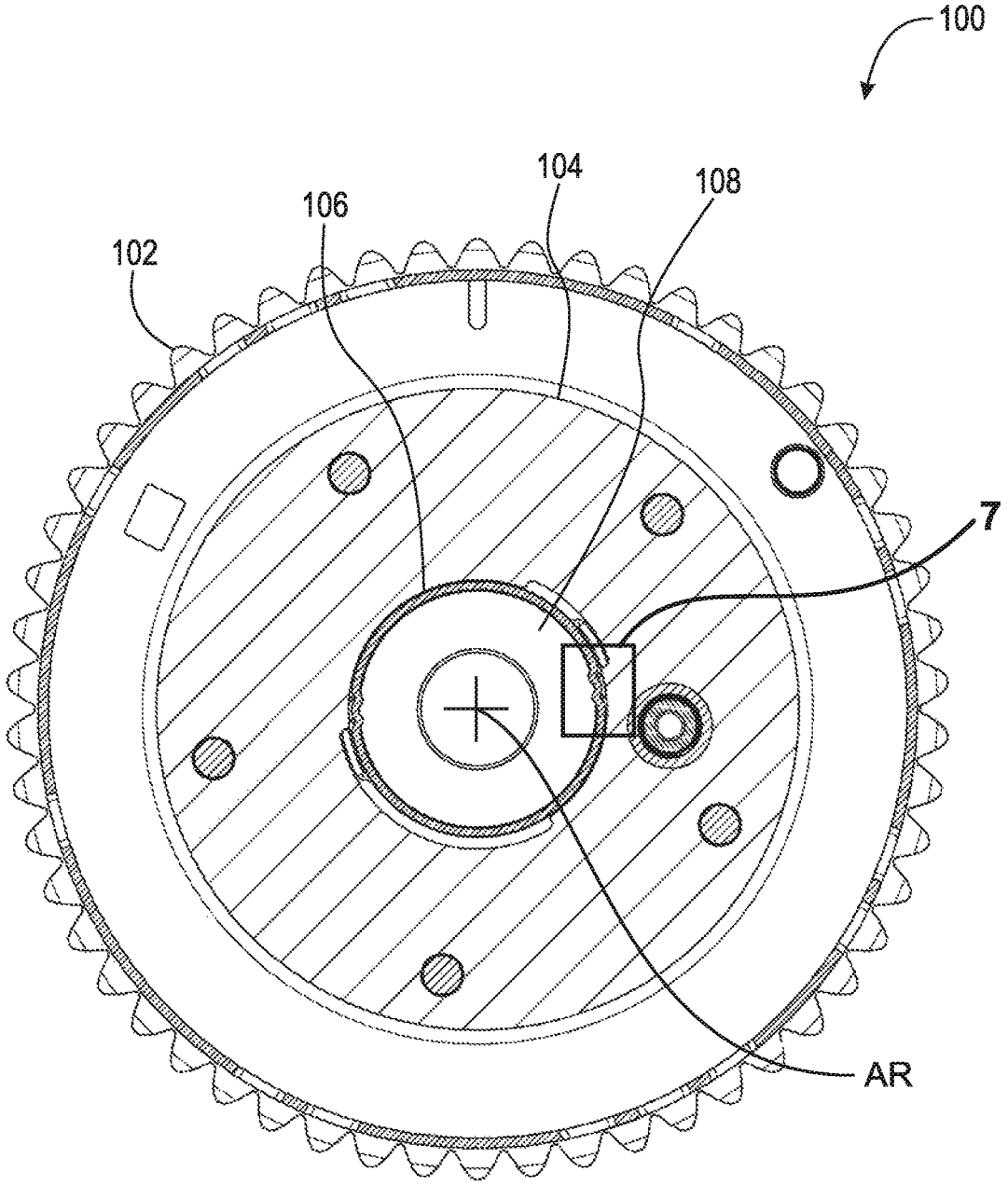
FIG. 6 is a cross-sectional view generally along line 6-6 in FIG. 3.

FIG. 6 is a cross-sectional view generally along line 6-6 in FIG. 3.

Figure 7:
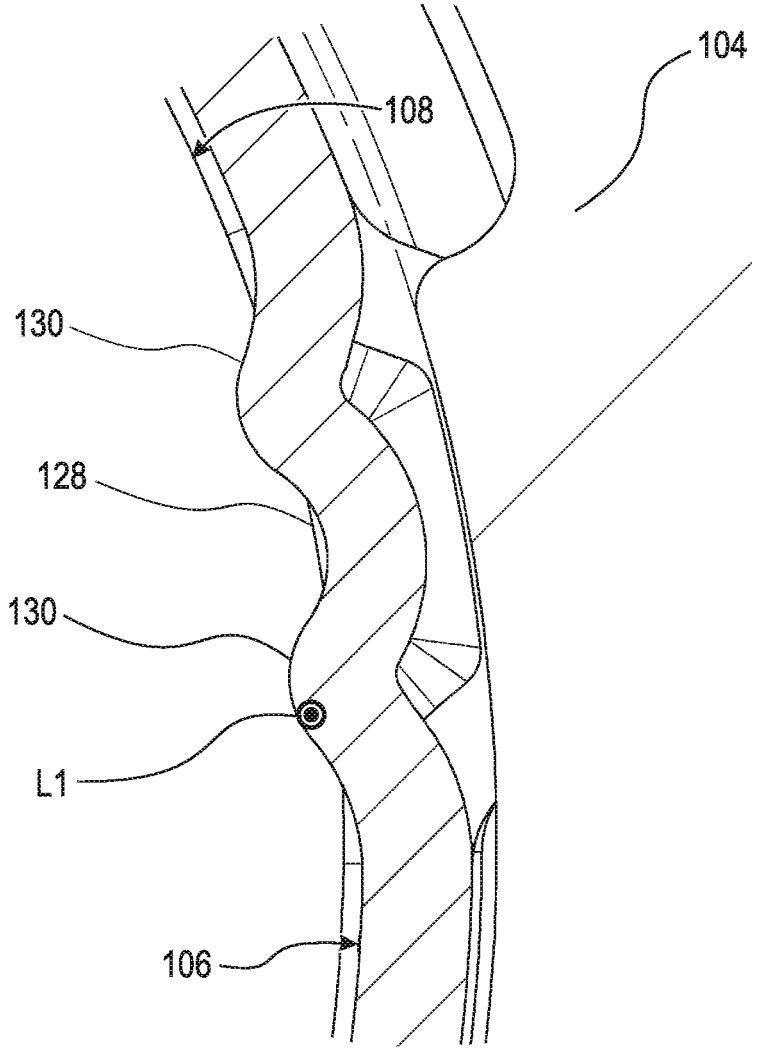
FIG. 7 is a detail of area 7 in FIG. 6.

FIG. 7 is a detail of area 7 in FIG. 6. The following should be viewed in light of FIGS. 1 through 7. Washer 108 includes radially outer circumference 128. In an example embodiment, target wheel 106 includes radially inwardly extending protrusions 130. Protrusions 130: extend past circumference 128 in radially inner direction RD (orthogonal to axis AR); and overlap washer 108 in axial directions AD1 and AD2. Hypothetical line L1, parallel to axis of rotation AR, passes through a radially inwardly extending protrusion 130 and washer 108.

In an example embodiment, portion 132 of target wheel 106 is radially outward of washer 108 and extends past washer 108 in axial direction AD1. In an example embodiment, an entirety of washer 108 is radially inward of stator 102. In an example embodiment, hypothetical line L2, orthogonal to axis of rotation AR, passes through in sequence, washer 108, target wheel 106, rotor 104, and stator 102.

Figure 8:
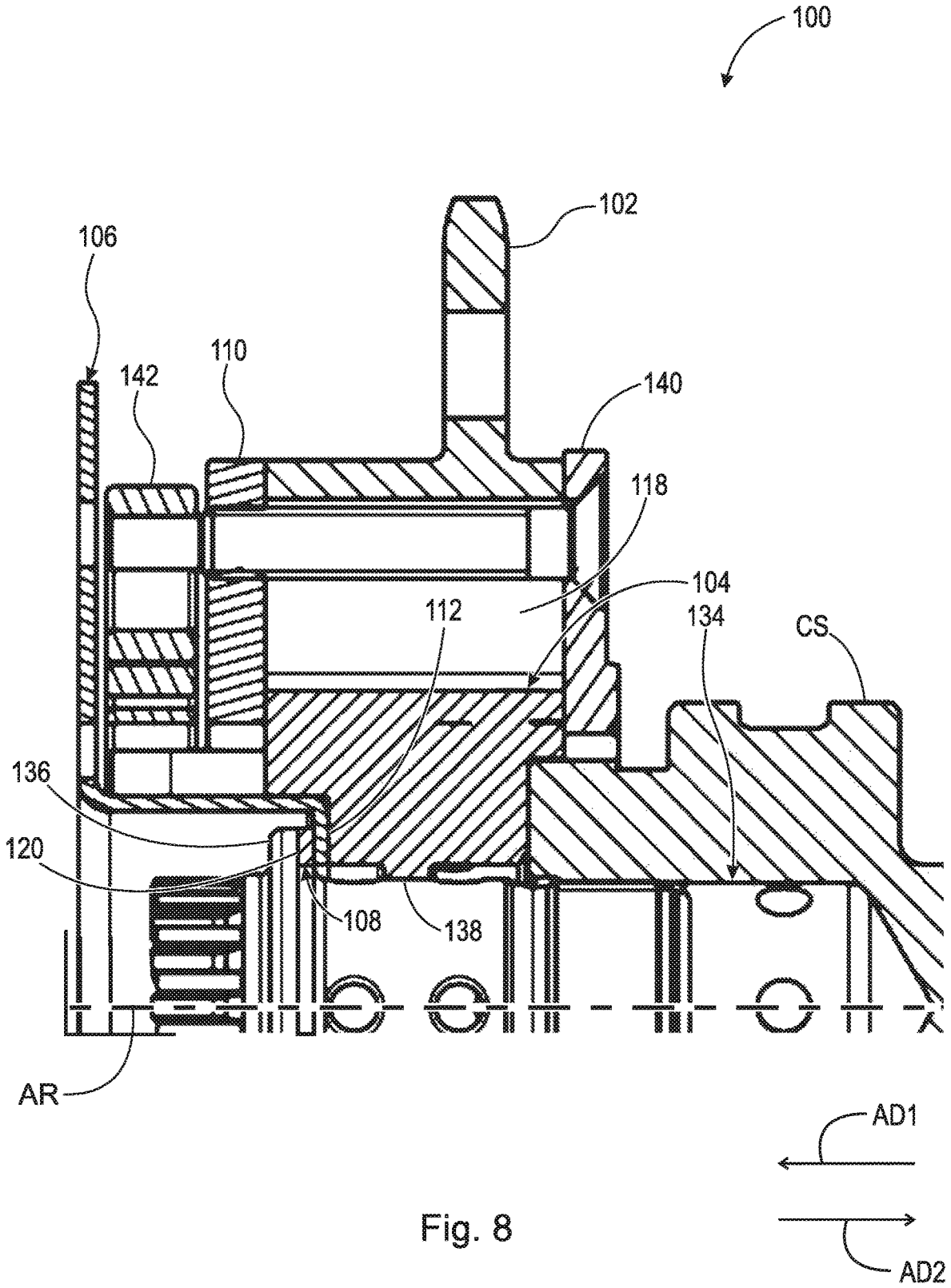
FIG. 8 is a partial cross-sectional view of a camshaft phaser with a target wheel washer and an oil control valve; and, FIG. 9 is a partial cross-sectional view of a camshaft phaser with a target wheel washer and a camshaft bolt.

FIG. 8 is a partial cross-sectional view of a camshaft phaser with a target wheel washer and an oil control valve. Except as noted, the discussion for camshaft phaser 100 shown in FIGS. 1 through 5 is applicable to camshaft phaser 100 shown in FIG. 8. In the example of FIG. 8, hydraulic phaser 100 includes oil control valve 134 with flange 136. Oil control valve 134 is non-rotatably connected to rotor 104 by any means known in the art, for example oil control valve 134 is threaded into rotor 104 at threaded portion 138 of rotor 104. Oil control valve 134 distributes fluid to chambers 118 to displace rotor 104 with respect to stator 102. Camshaft CS is arranged to be non-rotatably connected to valve 134. Flange 136 is in contact with side 120 of washer 108 to: clamp washer 108 to target wheel 106; and to clamp washer 108 and target wheel 106 to rotor 104.

Figure 9:
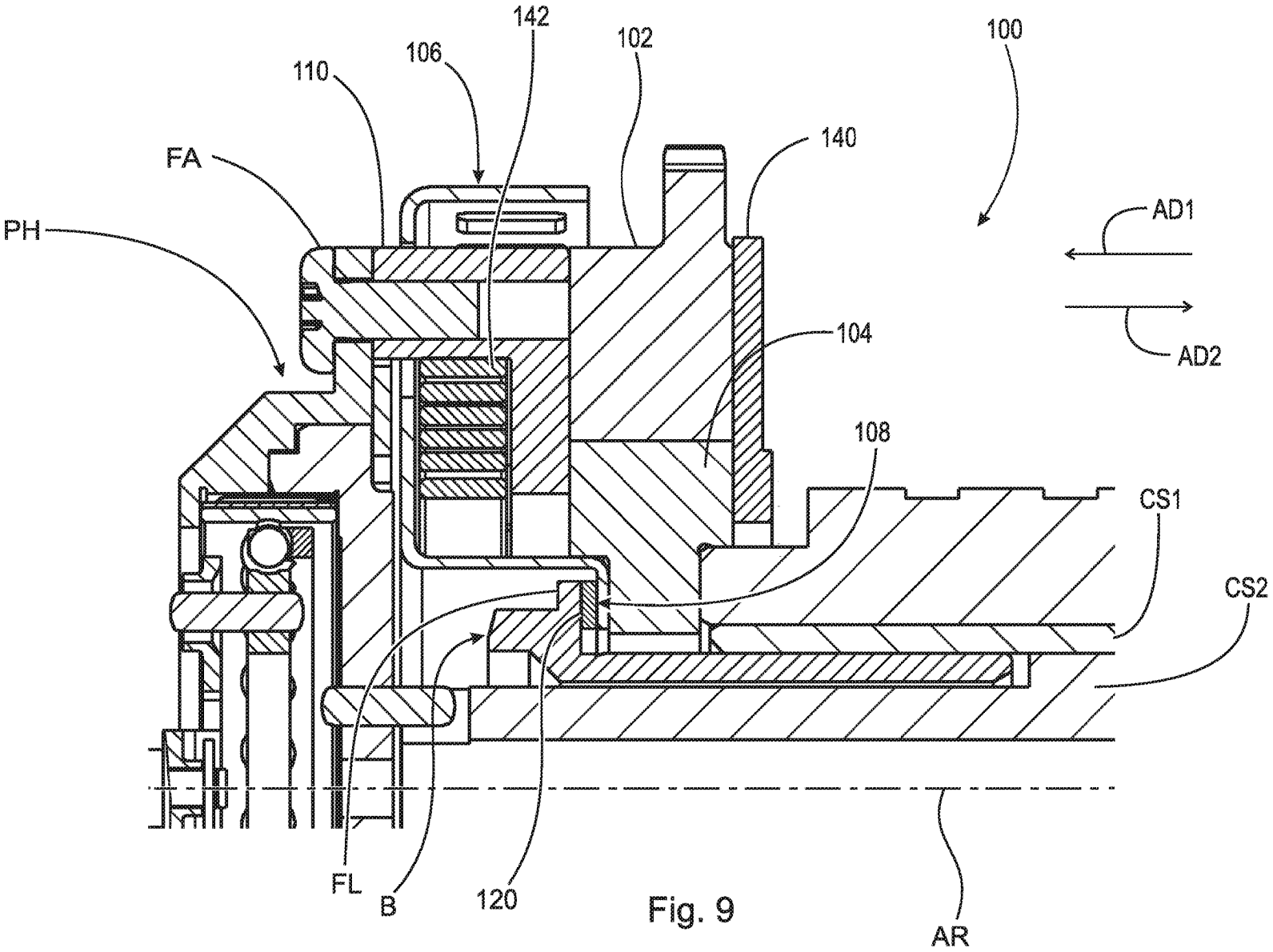

FIG. 9 is a partial cross-sectional view of a camshaft phaser with a target wheel washer and a camshaft bolt. Except as noted, the discussion for camshaft phaser 100 shown in FIGS. 1 through 5 is applicable to camshaft phaser 100 shown in FIG. 9. In the example of FIG. 9, target wheel 106 and rotor 104 are arranged to be non-rotatably connected to camshaft CS1 by camshaft bolt B. Bolt B is arranged to thread into camshaft CS1 and includes flange FL. Flange FL is arranged to contact side 120 of washer 108. Flange FL is arranged to: clamp washer 108 to target wheel 106; and clamp washer 108 and target wheel 106 to rotor 104. In the example of FIG. 9, camshaft phaser 100 is connected to electric camshaft phaser PH by fasteners FA. Camshaft phaser PH is connected to camshaft CS2.

In the example of FIGS. 1, 8, and 9, camshaft phaser 100 includes back plate 140 and bias spring 142. As is known in the art, bias spring 142 is used to rotate target wheel 106 to a predetermined circumferential position.

It is necessary for a target wheel of a camshaft phaser to remain fixed in a predetermined rotational position with respect to a rotor of the camshaft phaser to enable the target wheel to accurately track the rotational position of the rotor, which in turn is necessary to properly control a camshaft connected to the camshaft phaser. As noted above, in known camshaft phasers, frictional and rotational forces associated with the assembly and/or installation of the camshaft phaser can displace the target wheel from the predetermined rotational position. However, washer 108 isolates target wheel 106 from rotational and frictional forces associated with assembly or installation of camshaft phaser 100, enabling target 106 to remain in the predetermined rotational position, with respect to rotor 104, necessary for the proper operation of camshaft CS1.

As noted above, target wheel 106 has a lower hardness and a lower carbon content than rotor 104 and target wheel 106. In the example of FIG. 8, target wheel 106 has a lower hardness and a lower carbon content than flange 136. As a result, the coefficient of friction between valve 134 and washer 108 is less than the coefficient of friction between washer 108 and target wheel 106, and is less than the coefficient of friction between target wheel 106 and rotor 104. Thus, as valve 134 is rotated and displaced in direction AD2 into a final rotational position, flange 136 frictionally engages and rotationally slides along washer 108 while target wheel 106 remains rotationally fixed to rotor 104.

In the example of FIG. 9, target wheel 106 has a lower hardness and a lower carbon content than flange FL. As a result, the coefficient of friction between flange FL and washer 108 is less than the coefficient of friction between washer 108 and target wheel 106, and is less than the coefficient of friction between target wheel 106 and rotor 104. Thus, as bolt B is rotated and displaced in direction AD2 into a final rotational position, flange FL frictionally engages and rotationally slides along washer 108 while target wheel 106 remains rotationally fixed to rotor 104.

Washer 108 eliminates galling of target wheel 106 due to direct contact between target wheel 106 and valve 134 or bolt B. The galling can enable rotation of target wheel 106 from the predetermined rotational position. Further, washer 108 eliminates the use of grease during assembly of oil control valve 134, simplifying the assembly and installation of camshaft phaser 100 and reducing the costs associated with assembly and installation of camshaft phaser 100.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

AD1 axial direction
AD2 axial direction
AR axis of rotation
B camshaft bolt
CD1 circumferential direction
CD2 circumferential direction
CS camshaft
CS1 camshaft
CS2 camshaft
FA fastener
FL flange, bolt
L1 line
L2 line
RD radial direction
100 hydraulic camshaft phaser
102 stator
104 rotor
106 target wheel
108 annular washer
110 cover plate
111 back plate
112 portion, target wheel
114 radially inwardly extending protrusion
116 radially outwardly extending protrusion
118 phaser chamber
120 side, washer
122 side, washer
124 side, target wheel
126 side, target wheel
128 outer circumference, washer
130 protrusion, target wheel
132 portion, target wheel
134 oil control valve
136 flange, oil control valve
138 threaded portion, rotor
140 back plate
142 bias spring

The invention claimed is:

1. A camshaft phaser, comprising:
a stator:
arranged to receive rotational torque;
including a plurality of radially inwardly extending protrusions; and,
supported for rotation around an axis of rotation;
a rotor:
including a plurality of radially outwardly extending protrusions circumferentially interleaved with the plurality of radially inwardly extending protrusions; and,
arranged to non-rotatably connect to a camshaft;
a plurality of phaser chambers, each phaser chamber circumferentially bounded by:
a radially inwardly extending protrusion included in the plurality of radially inwardly extending protrusions; and,
a radially outwardly extending protrusion included in the plurality of radially outwardly extending protrusions;
an annular washer; and,
a target wheel:
including a first portion axially located between the annular washer and the rotor and in contact with the annular washer; and,
arranged to detect a rotational position of the rotor for use in rotating the rotor with respect to the stator, wherein:
the camshaft phaser further comprises an oil control valve non-rotatably connected to the rotor and including a flange, the oil control valve is arranged to distribute a fluid to the plurality of phaser chambers, the first portion of the annular washer includes a first surface facing in a first axial direction parallel to the axis of rotation, the flange is in contact with the first surface of the first portion, the annular washer has a first coefficient of friction with the flange of the oil control valve, the annular washer has a second coefficient of friction with the target wheel, and the first coefficient of friction is less than the second coefficient of friction; or,
the first portion of the annular washer includes a first surface facing in a first axial direction parallel to the axis of rotation, the first surface of the first portion is arranged to contact a bolt arranged to non-rotatably connect the rotor to the camshaft, the annular washer has a first coefficient of friction with the bolt, the annular washer has a second coefficient of friction with the target wheel, and the first coefficient of friction is less than the second coefficient of friction.

2. The camshaft phaser of claim 1, wherein:

the camshaft phaser further comprises the oil control valve, the first portion of the annular washer includes the first surface facing in the first axial direction, the flange is in contact with the first surface of the first portion, the annular washer has the first coefficient of friction with the flange of the oil control valve, the annular washer has the second coefficient of friction with the target wheel, and the first coefficient of friction is less than the second coefficient of friction;

the first portion of the annular washer includes a second surface facing in a second axial direction, opposite first axial direction; and, the second surface of the first portion is in contact with the target wheel.

3. The camshaft phaser of claim 1, wherein the oil control valve clamps the first portion of the annular washer and the target wheel to the rotor.

4. The camshaft phaser of claim 1, wherein:

the first portion of the annular washer includes a first surface facing in the first axial direction, the first surface of the first portion is arranged to contact the bolt, the annular washer has the first coefficient of friction with the bolt, the annular washer has the second coefficient of friction with the target wheel, and the first coefficient of friction is less than the second coefficient of friction;

the first portion of the annular washer includes a second surface facing in a second axial direction, opposite first axial direction; and, the second surface of the first portion is in contact with the target wheel.

5. The camshaft phaser of claim 1, wherein the bolt is arranged to clamp the first portion of the annular washer and the target wheel to the rotor.

6. The camshaft phaser of claim 1, wherein:

the target wheel has a first hardness;

the annular washer has a second hardness; and, the second hardness is greater than the first hardness.

7. The camshaft phaser of claim 1, wherein:

the target wheel includes a radially inwardly extending protrusion in contact with the annular washer; and, a hypothetical line, parallel to the axis of rotation, passes through, in sequence, the rotor, the annular washer, and the radially inwardly extending protrusion.

8. The camshaft phaser of claim 1, wherein a hypothetical line, orthogonal to the axis of rotation, passes through in sequence, the annular washer, the target wheel, the rotor, and the stator.

9. A camshaft phaser, comprising:

a stator:

arranged to receive rotational torque;

including a plurality of radially inwardly extending protrusions; and, supported for rotation around an axis of rotation;

a rotor:

including a plurality of radially outwardly extending protrusions circumferentially interleaved with the plurality of radially inwardly extending protrusions; and, arranged to non-rotatably connect to a camshaft;

a plurality of phaser chambers, each phaser chamber circumferentially bounded by:

a radially inwardly extending protrusion included in the plurality of radially inwardly extending protrusions; and, a radially outwardly extending protrusion included in the plurality of radially outwardly extending protrusions;

an annular washer; and, a target wheel:

including a first portion axially located between the annular washer and the rotor and in contact with the annular washer;

including a radially inwardly extending protrusion; and, arranged to detect a rotational position of the rotor for use in rotating the rotor with respect to the stator, wherein a hypothetical line, parallel to the axis of rotation, passes through, in sequence, the rotor, the first portion of the target wheel, the annular washer, and the radially inwardly extending protrusion.

10. The camshaft phaser of claim 9 wherein the first portion of the target wheel is in contact with the rotor.

11. A camshaft phaser, comprising:

a stator:

arranged to receive rotational torque;

including a plurality of radially inwardly extending protrusions; and, supported for rotation around an axis of rotation;

a rotor:

including a plurality of radially outwardly extending protrusions circumferentially interleaved with the plurality of radially inwardly extending protrusions; and, arranged to non-rotatably connect to a camshaft;

a plurality of phaser chambers, each phaser chamber circumferentially bounded by:

a radially inwardly extending protrusion included in the plurality of radially inwardly extending protrusions; and, a radially outwardly extending protrusion included in the plurality of radially outwardly extending protrusions;

an annular washer; and, a target wheel:

including a first portion axially located between the annular washer and the rotor and in contact with the annular washer;

including a radially inwardly extending protrusion, separate from the first portion, overlapping the annular washer in an axial direction parallel to the axis of rotation; and, arranged to detect a rotational position of the rotor for use in rotating the rotor with respect to the stator.

12. The camshaft phaser of claim 11 wherein the annular washer is axially disposed between the first portion of the target wheel and the radially inwardly extending protrusion of the target wheel.

13. The camshaft phaser of claim 11 wherein the first portion of the target wheel is in contact with the rotor.

* * * * *